US009228813B1

(12) United States Patent
Pedersen

(10) Patent No.: US 9,228,813 B1
(45) Date of Patent: Jan. 5, 2016

(54) BROADHEAD COLLARS

(71) Applicant: Out RAGE, LLC, Catersville, GA (US)

(72) Inventor: William E. Pedersen, Duluth, MN (US)

(73) Assignee: Out RAGE, LLC, Cartersville, GA (US)

( * ) Notice: Subject to any disclaimer, the term of this patent is extended or adjusted under 35 U.S.C. 154(b) by 0 days.

(21) Appl. No.: 14/338,660

(22) Filed: Jul. 23, 2014

(51) Int. Cl.
*F42B 6/08* (2006.01)

(52) U.S. Cl.
CPC ..... *F42B 6/08* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 4,381,866 | A | 5/1983 | Simo | |
| 4,452,460 | A | 6/1984 | Adams | |
| 4,671,517 | A | 6/1987 | Winters | |
| 5,482,293 | A | 1/1996 | Lekavich | |
| 6,200,237 | B1 | 3/2001 | Barrie | |
| 6,793,596 | B1 | 9/2004 | Sullivan et al. | |
| 6,887,172 | B2 * | 5/2005 | Arasmith | 473/583 |
| 7,226,375 | B1 * | 6/2007 | Sanford | 473/583 |
| 8,016,703 | B1 * | 9/2011 | Kronengold et al. | 473/582 |
| 8,758,176 | B2 | 6/2014 | Pedersen | |
| 2002/0098926 | A1 | 7/2002 | Liechty | |
| 2003/0073525 | A1 | 4/2003 | Liechty | |

OTHER PUBLICATIONS

Action Closing Prosecution (nonfinal), mailed by the USPTO on May 21, 2102 in case U.S. Appl. No. 95/001,854, filed Dec. 14, 2011.
Bowhunting Equipment Buyers Guide, 1997, 3pp.
"Bowhunting Tactics," Petersen's Bowhunting Magazine, Oct. 18, 2004, 5 pp., www.outdoorsbest.com.
Bowhunting World, Feb. 1997, 2 pp.
Bowhunting World: Bowhunting Guide '89-'90, vol. 38, No. 7, 2 pp., 1989-1990 edition.
Bowhunting World: Equipment Guide '94, vol. 43, No. 5, Jul. 1994, 3 pp.
"Broadhead Collecting—As Easy As A.B.C.C.," Stickbow.com, Copyright 2002, 8 pp.
D. H. Pauley letter to R. L. Rainey regarding Reissue U.S. Appl. No. 11/823,458; letter dated Aug. 2, 2011.
D. H. Pauley letter to R. L. Rainey regarding Reissue U.S. Appl. No. 11/823,458; letter dated Aug. 31, 2011.
Declaration of Andy Simo to Establish date of Invention Prior to Critical date of U.S. Appl. No. 11/823,458; Declaration dated Aug. 31, 2011.

(Continued)

*Primary Examiner* — John Ricci
(74) *Attorney, Agent, or Firm* — Covington & Burling LLP; Gregory S. Discher; Grant D. Johnson

(57) ABSTRACT

Collars are provided for broadheads. In some embodiments, the collars are shock collars with frangible tabs which restrain the blades of an expandable broadhead during flight, stabilizing the flight path of the expandable broadhead. The frangible tabs break off of the shock collar upon impact, allowing the blades of the expandable broadhead to deploy and increase the size of the entrance hole made in the target. In some embodiments, the collars center a ferrule of a broadhead within an insert of an arrow.

23 Claims, 22 Drawing Sheets

(56) References Cited

OTHER PUBLICATIONS

Declaration of Bob Mizek to Establish date of Invention Prior to Critical date of U.S. Appl. No. 11/823,458; Declaration dated Aug. 31, 2011.
Declaration of Chris Kozlik to Establish date of Invention Prior to Critical date of U.S. Appl. No. 11/823,458; Declaration dated Aug. 31, 2011.
Email from A. Simo to R. Krause, dated Sep. 14, 2011.
Email from A. Simo to R. Krause, dated Sep. 19, 2011, and related emails.
Email from Andy Simo to Rich Krause, dated Sep. 28, 2011.
Email from D. Pauley to G. Discher, dated Sep. 13, 2011.
Email from J. Fowler to D. Pauley, dated Aug. 19, 2011, and related emails.
Email from R. Krause to A. Simo, dated Sep. 16, 2011.
Email from R. Krause to A. Simo, dated Sep. 20, 2011.
Email from R. Krause to A. Simo, dated Sep. 28, 2011, and related email.
Email from rmizek@newarchery to B. Barrie, re: Amo Show; dated Jan. 30, 2001.
Email with two (2) attachments from A. Simo to R. Krause, dated Sep. 22, 2011.
*Field Logic* v. *G5 Outdoors*, No. 06cv01724 Defendant's Prior Art Chart (12 pages), dated Jun. 27, 2007.
New Archery Products Corp. ("NAP"), letter from A. Simo to R. Krause regarding U.S. Patent Nos. 6,517,454, 6,626,776, and 6,910,979; letter dated Jul. 22, 2011.
"New Products for 1997," Rich Walton's Industry News, 9 pp., http://www.bowhunting.net/richwalton/97newproducts.html.
Order for Dismissal Without Predudice, May 8, 2009.
Petition Under 37 C.F.R. § 1.182 and/or § 1.183, a Protest Under 37 C.F.R. § 1.291(a) with Exhibits 1-5, and Declaration of Robert Mizek Under 37 C.F.R. § 1.132, initially submitted to the USPTO on Jan. 31, 2012 by Mr. Allan A. Fanucci.
Plaintiff Out Rage LLC's Identification of Asserted Claims and Accused Products, dated Feb. 3, 2012.
R. L. Rainey letter to A. Simo, dated Aug. 1, 2011.
R. L. Rainey letter to D. H. Pauley, dated Aug. 17, 2011.
Request for Inter Partes Reexamination of U.S. Pat. No. 6,626,776, filed Dec. 14, 2011.
Response to Office Action in Inter Partes Reexamination under 37 C.F.R. § 1.945 and M.P.E.P. § 2666, filed in the USPTO on Mar. 28, 2102 in U.S. Appl. No. 95/001,854, filed Dec. 14, 2011.
Stipulation for Dismissal Without Predudice, May 6, 2009.
Third Party Requester's Comments to Patent Owner's Reply of Mar. 28, 2012 Pursuant to 37 C.F.R. § 1.947, dated Apr. 27, 2012.
Two photographs which are duplications of original photograph, taken of expandable broadheads of the same construction as those that were shown in the photograph provided with the email from rmizek@newarchery to B. Barrie, dated Jan. 30, 2001.

* cited by examiner

BROADHEAD COLLARS

TECHNICAL FIELD OF THE INVENTION

Embodiments of the present invention generally relate to collars for broadheads, also referred to as arrowheads, arrowtips, broadhead arrowheads or broadhead arrowtips. More particularly, embodiments of the present invention relate to blade stabilizing and retaining collars for expandable broadheads which have an in-flight configuration with the blades of the broadhead retracted, and which deploy their blades outwardly upon striking a target to result in a larger entrance opening in the target. Embodiments of the present invention also relate to collars configured to cover an outer portion of a ferrule of a broadhead, which act to center the ferrule within an insert in an arrow body.

BACKGROUND OF THE INVENTION

Expandable broadheads that utilize a rear deploying expandable blade structure that does not hang up or get stuck in a ferrule slot, while at the same time improving penetration capabilities as well as facilitating arrow removal after target penetration, are disclosed in co-pending U.S. patent application Ser. No. 13/998,888, the contents of which are fully incorporated herein by reference. These expandable broadheads avoid blade-to-blade interference as the blades deploy.

In certain expandable broadheads, a shock collar is used to restrain the blades during the flight of the expandable broadhead. Upon impact of the expandable broadhead into a target, a portion of the shock collar breaks free, allowing the blades to deploy outwardly and expanding the total cutting surface of the expandable broadhead. This deployed impact configuration allows the expandable broadhead to create a larger entrance hole in the surface of a target, while the restrained in-flight configuration ensures maximum aerodynamic accuracy during flight. Shock collars for expandable broadheads are disclosed in U.S. Pat. No. 8,758,176, the contents of which are also fully incorporated herein by reference. The shock collars described in the U.S. Pat. No. 8,758,176 patent contain the blades of an expandable during flight, ensuring the broadhead's stability.

While these existing shock collars, as shown in 100 of FIG. 1, are effective for expandable broadheads having two deployable blades, there remains a need for lightweight, reliable shock collars for expandable broadheads having three or more deployable blades. Such shock collars should retain the deployable blades of the expandable broadhead during flight to maximize the accuracy of an arrow, while at the same time ensuring that an archer can rely on the collar to break on impact, allowing the blades to deploy upon impact into a target.

Furthermore, weight is a consideration when designing broadheads. The ferrules of existing broadhead designs are essential in centering those broadheads within the insert of an arrow, ensuring aerodynamic stability during flight. However, these ferrules are typically made of dense, heavy materials such as steel. Lightweight broadhead collars that could effectively center a ferrule within an arrow insert, while at the same time allowing the dimensions of the ferrule to shrink, would allow broadhead designers to add weight to different locations of the broadhead, achieving greater strength, durability, and cutting performance than was previously possible. Additionally, lightweight broadhead collars made of deformable materials could allow an interference fit between a ferrule, collar, and arrow insert, resulting in the centering of an broadhead within an arrow insert to promote in-flight performance and accuracy.

SUMMARY OF THE INVENTION

The present invention is directed, in certain embodiments, to blade retaining collars for use with an expandable broadhead. The collars include a forward portion and a rear cylindrical portion. The forward portion features a plurality of frangible tabs, each tab configured to restrain a deployable blade of the expandable broadhead in a first position, wherein each frangible tab is configured to break off of the collar upon an impact of the expandable broadhead, allowing each of the deployable blades to rotate and translate into a second position. The rear cylindrical portion is configured to reside on an outer portion of a ferrule of the expandable broadhead, and configured to center the ferrule within an insert in an arrow.

In certain embodiments of the invention, the impact of the expandable broadhead causes each deployable blade of the expandable broadhead to apply axial and tangential forces to a respective frangible tab configured to restrain the deployable blade. In certain further embodiments of the invention, the axial and tangential forces cause the respective frangible tab to break off of the collar. In certain embodiments of the invention, each of the plurality of frangible tabs includes a cut which facilitates the ability of each of the plurality of frangible tabs to break off of the collar upon the impact. In certain further embodiments of the invention, the forward portion of the collar includes three frangible tabs, and the expandable broadhead utilizes three deployable blades.

In certain embodiments of the invention, each of the plurality of frangible tabs includes a seating location, where each seating location is configured to receive a hook of the respective deployable blade that the frangible tab is configured to restrain. In certain further embodiments of the invention, each of the plurality of frangible tabs is overlaid on the hook of the respective deployable blade which the frangible tab is configured to restrain in the first position. In certain further embodiments of the invention, each of the plurality of frangible tabs prevents the respective deployable blade which the frangible tab is configured to restrain from moving during flight of the arrow.

In certain embodiments of the invention, the collar includes one or more shock absorbing materials such as nylon, polypropylene, polymethylmethacrylate (PMMA), glass filled nylon, polycarbonate, aluminum, zinc, powder metal, and ceramic. In certain further embodiments of the invention, the shock absorbing material is impregnated with one or more friction reducing additives such as polytetrafluoroethylene (PTFE), graphite, molybdenum disulfide ($MoS_2$), and nanoparticles, such as zinc or silica nanoparticles. The friction reducing additives advantageously reduce the coefficient of friction of the one or more shock absorbing materials. In certain further embodiments of the invention, the ceramic is a ceramic material such as silicon nitride ($Si_3N_4$), silicon carbide (SiC), aluminum oxide ($Al_2O_3$), zirconium oxide ($ZrO_2$), tungsten carbide (WC), and partially stabilized zirconia. In certain further embodiments of the invention, the powder metal is a sintered powder metal or an injection molded powder metal. The powdered metal can be stainless steel, brass, bronze, or titanium.

In certain embodiments of the invention, the size of the rear cylindrical portion creates an interference fit between the ferrule and the insert in the arrow. In certain further embodiments of the invention, the ferrule is steel, and the rear cylindrical portion can include one or more polymeric materials such as nylon, polypropylene, and PMMA. In certain further embodiments of the invention, the rear cylindrical portion has a density of approximately 0.04 lb/in$^3$, and the ferrule has a density in the range of approximately 0.09 lb/in$^3$ to 0.29 lb/in$^3$.

Embodiments of the present invention are directed to blade retaining collars for use with a broadhead. The collars include a cylindrical portion, wherein the cylindrical portion resides on an outer portion of a ferrule of the broadhead, and the size of the cylindrical portion creates an interference fit between the outer portion of the ferrule of the broadhead and an insert in an arrow.

In certain embodiments of the invention, a material of the rear cylindrical portion deforms more readily than a material of the ferrule.

In certain embodiments of the invention, the ferrule is steel, and the rear cylindrical portion can include one or more polymeric materials such as nylon, polypropylene, and PMMA.

In certain embodiments of the invention, the collar includes one or more shock absorbing materials such as nylon, polypropylene, PMMA, glass filled nylon, polycarbonate, aluminum, zinc, powder metal, and ceramic. In certain further embodiments of the invention, the shock absorbing material is impregnated with one or more friction reducing additives such as PTFE, graphite, molybdenum disulfide ($MoS_2$), and nanoparticles, such as zinc or silica nanoparticles. The friction reducing additives advantageously reduce the coefficient of friction of the one or more shock absorbing materials.

In certain embodiments of the invention, the rear cylindrical portion has a density of approximately 0.04 lb/in$^3$, and the ferrule has a density in the range of approximately 0.09 lb/in$^3$ to 0.29 lb/in$^3$.

In certain embodiments of the invention, the broadhead can be a fixed-blade broadhead, a cartridge style expandable broadhead, an over-the-top expandable broadhead, a pivoting expandable broadhead, a rearward deploying expandable broadhead, and/or a hybrid broadhead.

DETAILED DESCRIPTION OF THE INVENTION

Figure 1:
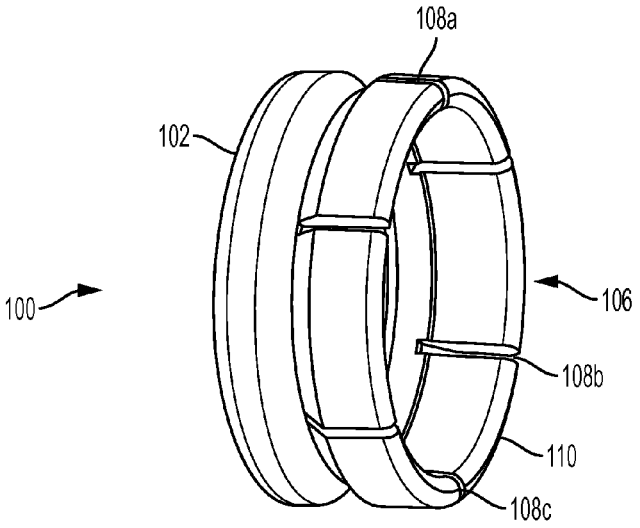
FIG. 1 is an exemplary perspective view of an existing shock collar with tabs designed to break upon impact with the target.

FIG. 1, generally at 100, is an exemplary perspective view of an existing polymeric version of a broadhead collar 100. The collar 100 consists of a lower annular portion 102, an intermediate annular portion 104, and an upper annular portion 106. The intermediate annular portion 104 has a smaller relative radius than the lower annular portion and the upper annular portion 106. The upper annular portion 106 has a plurality of slots shown, for example, at 108*a*, 108*b*, 108*c*. In one embodiment, the slots 108*a*, 108*b*, 108*c* extend to an upper portion of the intermediate annular portion 104. A tab 110 is formed between each slot 108*a*, 108*b*, 108*c*. For example, section 110 is shown between slots 108*b* and 108*c*.

Exemplary two-bladed broadheads that the existing collars 100 can be used with can be found, for example, in U.S. Pat. No. 6,910,979, which is incorporated herein by reference herein in its entirety. The collar 100 is designed to break on impact. In some embodiments, the existing collars are made from one or more polymeric materials such as nylon, polypropylene, and polymethylmethacrylate (PMMA).

Figure 2A:
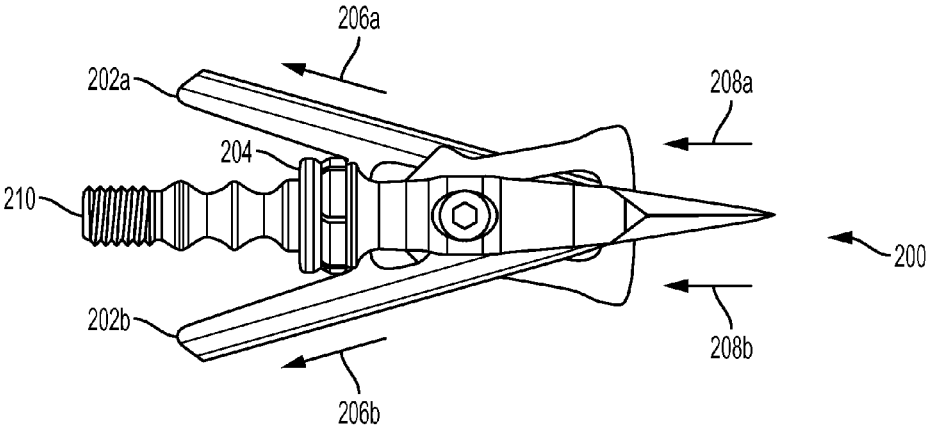
FIG. 2A is a first exemplary side view of an existing two-bladed broadhead, featuring a shock collar as shown in FIG. 1, in an in-flight configuration.
Figure 2B:
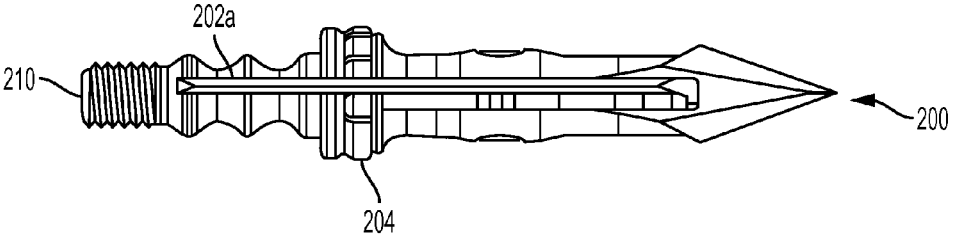
FIG. 2B is a second exemplary side view of an existing two-bladed broadhead, featuring a shock collar as shown in FIG. 1, in an in-flight configuration.

FIG. 2A, generally at 200, is an exemplary first side view of an existing two-bladed expandable broadhead 200 that an existing collar 204 can be used with to restrain blades 202*a* and 202*b* during flight. Upon impact of the expandable broadhead 200 into a target, the blades 202*a* and 202*b* exert axial 208*a* and 208*b* and tangential 206*a* and 206*b* forces onto the collar 204, causing the collar 204 to ultimately break. The threaded end 210 of the two-bladed broadhead 200 is threaded onto a conventional arrow insert (not shown) that receives and mates with threaded end 210 of the broadhead 200. FIG. 2B is an exemplary second side view of the existing two bladed broadhead 200 in its in-flight configuration, as displayed in FIG. 2A.

Figure 2C:
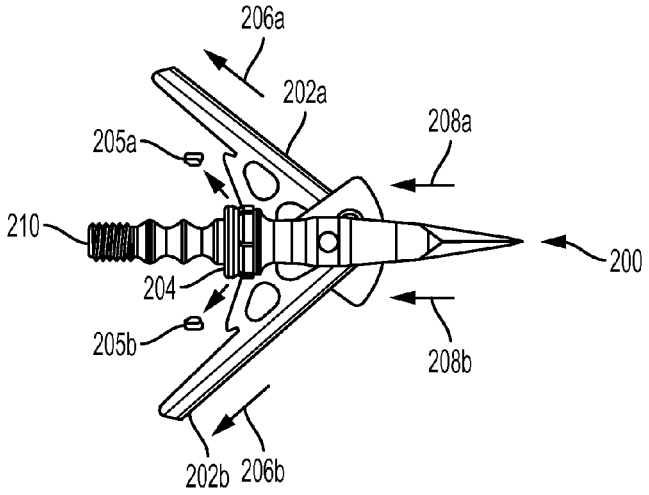
FIG. 2C is a first exemplary side view of an existing two-bladed broadhead, featuring a shock collar as shown in FIG. 1, in a fully deployed configuration.
Figure 2D:
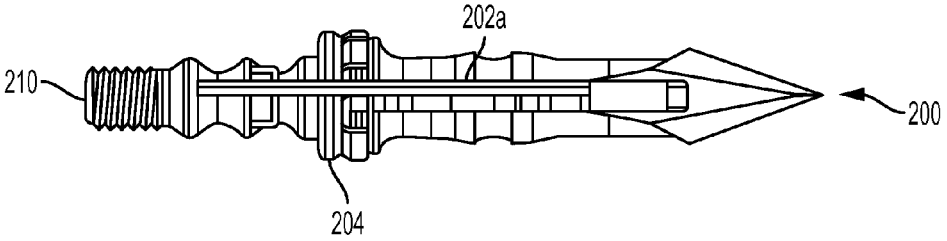
FIG. 2D is a second exemplary side view of an existing two-bladed broadhead, featuring a shock collar as shown in FIG. 1, in a fully deployed configuration.
Figure 2E:
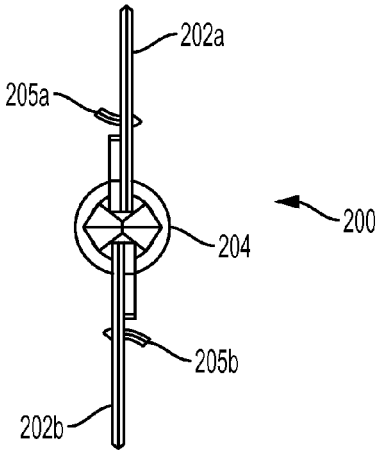
FIG. 2E is an exemplary front view of an existing two-bladed broadhead, featuring a shock collar as shown in FIG. 1, in a fully deployed configuration.

FIG. 2C is an exemplary first side view of the existing two-bladed expandable broadhead 200 after impact, with the blades 202*a* and 202*b* fully deployed. The axial 208*a* and 208*b* and tangential 206*a* and 206*b* forces exerted by blades 202*a* and 202*b* onto the collar 204 have caused tabs 205*a* and 205*b* to break off of collar 204, allowing blades 202*a* and 202*b* to fully deploy. FIG. 2D is an exemplary second side view of the existing two bladed broadhead 200 in its fully deployed configuration, as displayed in FIG. 2A, and FIG. 2E is an exemplary front view of the existing two bladed broadhead 200 in its fully deployed configuration, as displayed in FIG. 2A.

Figure 3:
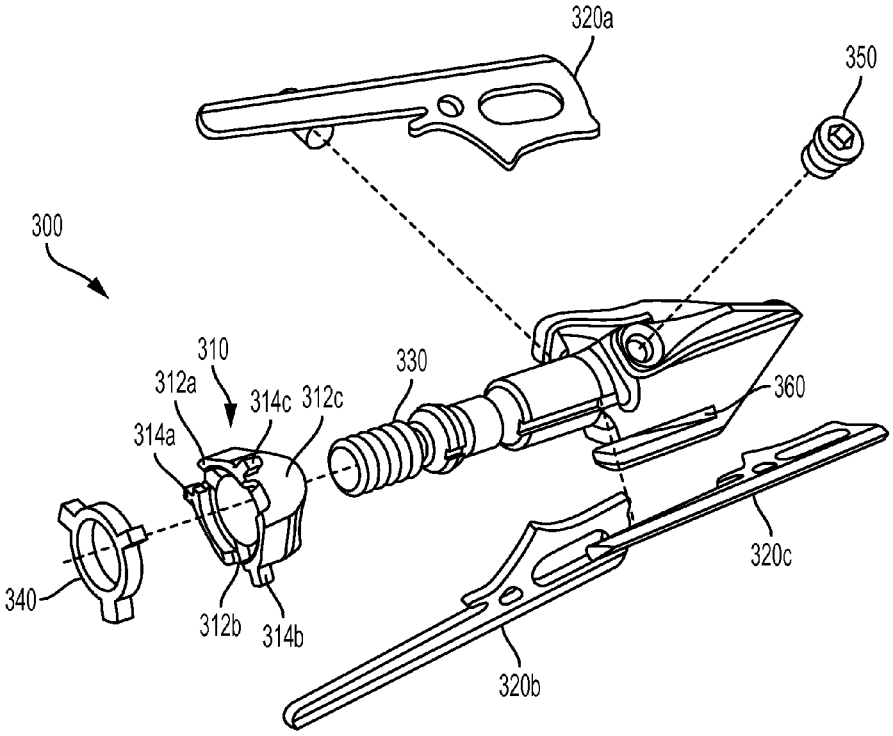
FIG. 3 is an exemplary exploded perspective view of an existing three-bladed expandable broadhead with a shock collar.

FIG. 3, generally at 300, is an exemplary exploded perspective view of an existing three-bladed expandable broadhead 300, with a collar 310 mounted to broadhead 300 along the central ferrule portion 330 of broadhead 300. Retaining pin 350 acts to retain deployable blades 320*a*, 320*b*, and 320*c* within the grooves 360 of the broadhead 300's ferrule body 330. The deployable blades 320*a*, 320*b*, and 320*c* are restrained in their in-flight position in the grooves 360 by collar 310. Specifically, the collar's frangible tabs 314*a*, 314*b*, and 314*c* act to lock the blades 320*a*, 320*b*, and 320*c* in place during flight.

Upon impact, the frangible tabs 314*a*, 314*b*, and 314*c* break off of collar 310, allowing blades 320*a*, 320*b*, and 320*c* to deploy. As the blades 320*a*, 320*b*, and 320*c* deploy rearwardly, they cam against specialty washer 340, which provides hard camming services to communicate with deployable blades 320*a*, 320*b*, and 320*c*. Specialty washer 340 is mounted to receiving slots 312*a*, 312*b*, and 312*c* in collar 310.

Figure 4A:
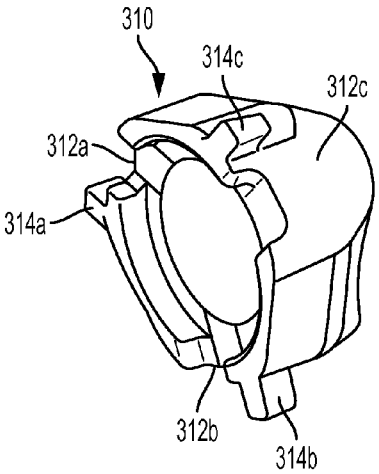
FIG. 4A is a first exemplary perspective view of the shock collar shown in FIG. 3.
Figure 4B:
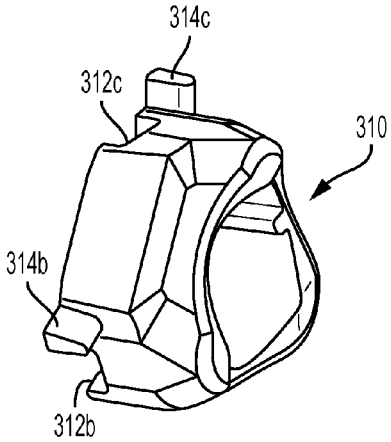
FIG. 4B is a second exemplary perspective view of the shock collar shown in FIG. 3.

FIGS. 4A and 4B provide first and second magnified perspective views of exemplary existing collar 310, its receiving slots 312*a*, 312*b*, and 312*c* for specialty washer 340, and its frangible tabs 314*a*, 314*b*, and 314*c* that restrain the broadhead 300's blades 320*a*, 320*b*, and 320*c* during flight, but break off upon the broadhead 300's impact into a target.

Figure 5A:
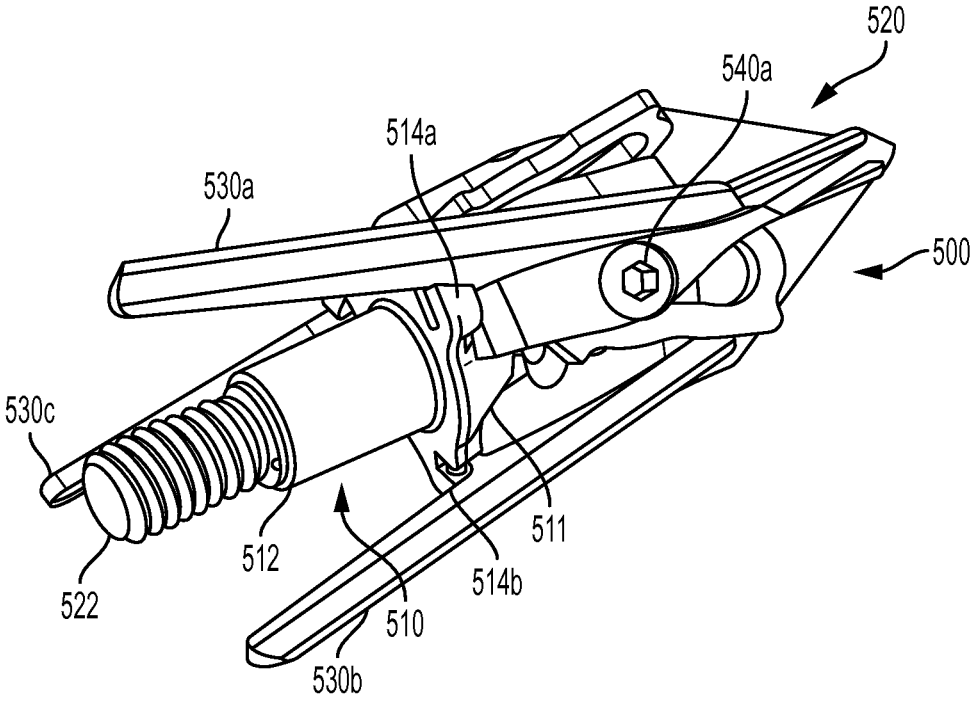
FIG. 5A is an exemplary perspective view of an embodiment of a three-bladed broadhead with a shock collar.
Figure 5B:
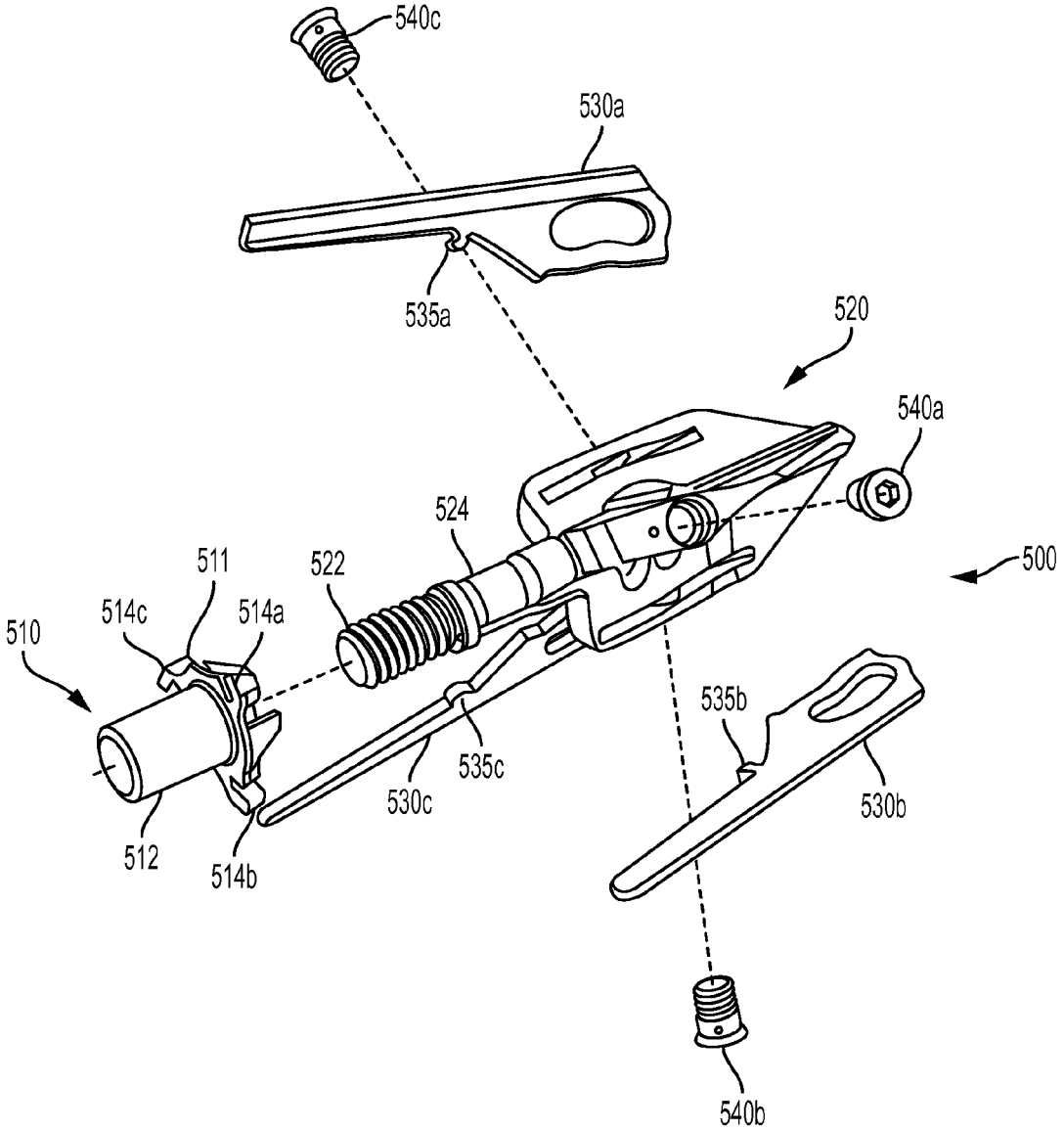
FIG. 5B is an exemplary exploded perspective view of the three-bladed broadhead of FIG. 5A.

FIG. 5A, generally at 500, provides a perspective view of a three-bladed deployable broadhead 500 of an exemplary embodiment of the present invention, and FIG. 5B provides an exploded perspective view of broadhead 500. The rear cylindrical portion 512 of collar 510 covers the outer portion 524 of the ferrule body 520, and the forward portion 511 of collar 510 includes frangible tabs 514*a*, 514*b*, and 514*c*, which each cover and overlay a respective hook 535*a*, 535*b*, and 535*c* of blades 530*a*, 530*b*, and 530*c*, causing blades 530*a*, 530*b*, and 530*c* of the broadhead 500 to be restrained by respective frangible tabs 514*a*, 514*b*, and 514*c* in the broadhead 500's in-flight configuration. Upon impact, the frangible tabs 514*a*, 514*b*, and 514*c* break off of collar 510, allowing the blades 530*a*, 530*b*, and 530*c* to deploy outwards. Blades 530*a*, 530*b*, and 530*c* are coupled to ferrule body 520 using retaining pins or fasteners 540*a*, 540*b*, and 540*c*.

The threaded base portion 522 of ferrule body 520 allows the broadhead 500 to be threadably and rotatably mounted in an arrow insert, a threaded bore at the front portion of an arrow shaft (not pictured). In embodiments of the present invention, the rear cylindrical portion 512 of collar 510 acts as a centering shim for broadhead 500 in the front portion of an arrow shaft, centering and stabilizing the broadhead 500 within the arrow. In embodiments of the invention, the rear cylindrical portion 512 is shaped to fill a volume of space between the outer portion 524 of ferrule body 520 and the arrow insert.

In embodiments of the present invention, the ferrule body 520 and blades 530*a*, 530*b*, and 530*c* are made from metals such as steel, stainless steel and/or titanium. Examples of metals for use in the ferrule body 520 and blades 530*a*, 530*b*, and 530*c* include 12L14 steel, 4140 steel, 4340 steel, 420 stainless steel, 440 stainless steel, 301 stainless steel, 304 stainless steel, $Ti_6Al_4V$ titanium, and grade 2 titanium. The blades 530*a*, 530*b*, and 530*c* can be made of a martensitic grade of stainless steel such as 420 or 440 stainless steel.

Figure 6A:
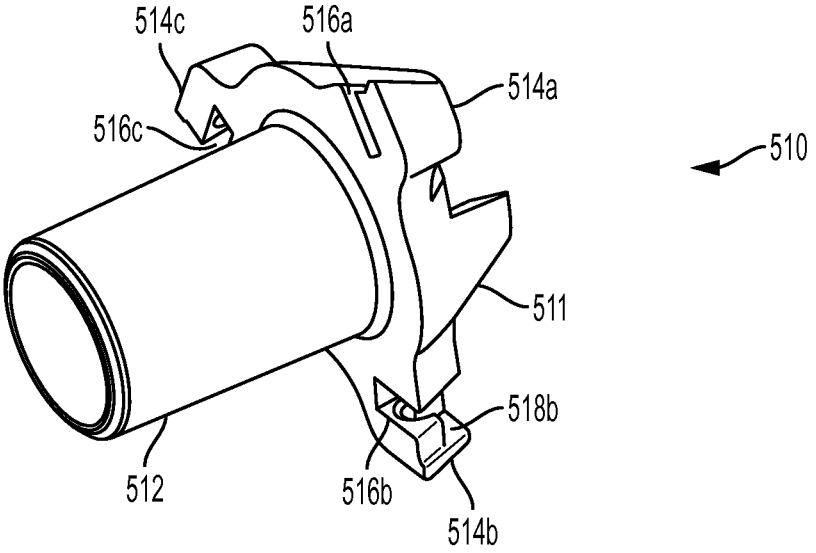
FIG. 6A is an exemplary perspective view of an embodiment of the shock collar for the three-bladed expandable broadhead shown in FIG. 5A and FIG. 5B.
Figure 6B:
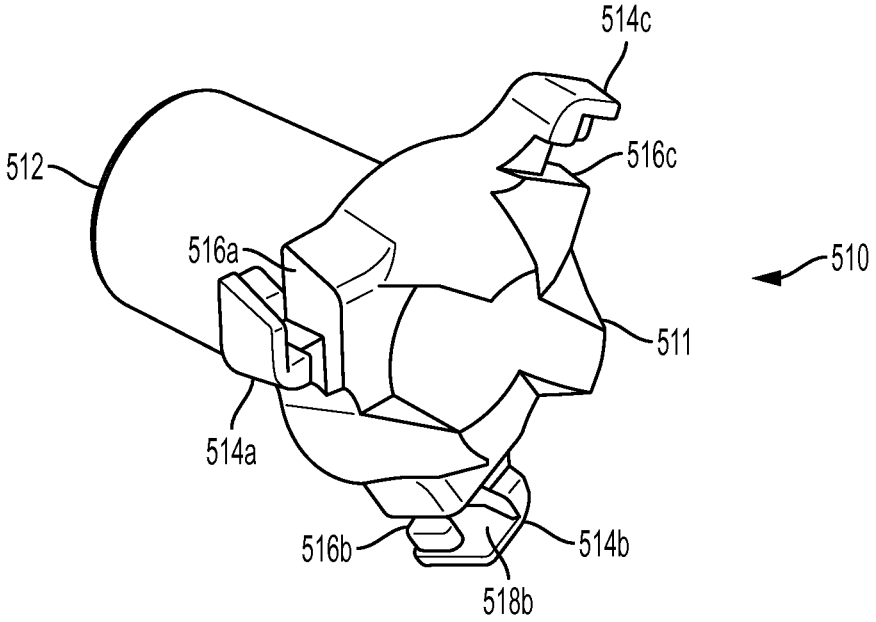
FIG. 6B is a second exemplary perspective view of an embodiment of the shock collar for the three-bladed expandable broadhead shown in FIG. 5A and FIG. 5B.
Figure 6C:
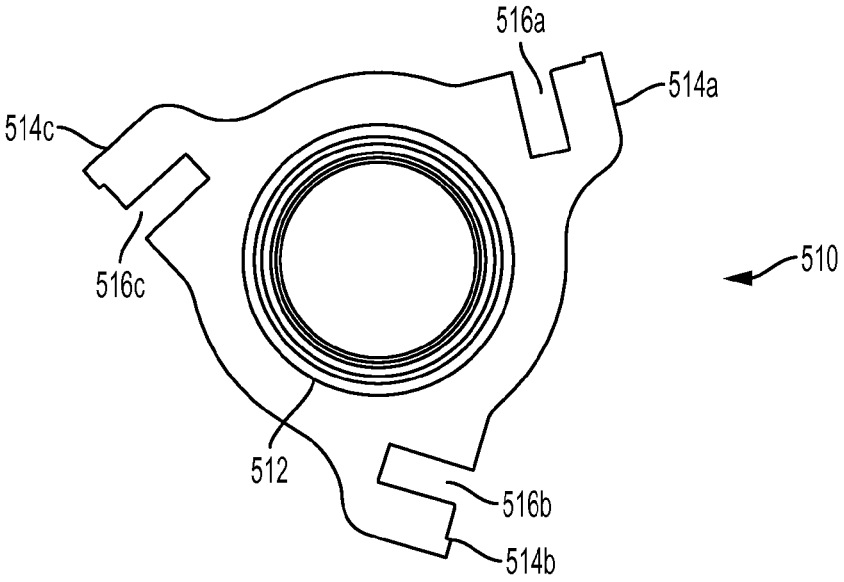
FIG. 6C is an exemplary rear view of an embodiment of the shock collar for the three-bladed expandable broadhead shown in FIG. 5A and FIG. 5B.
Figure 6D:
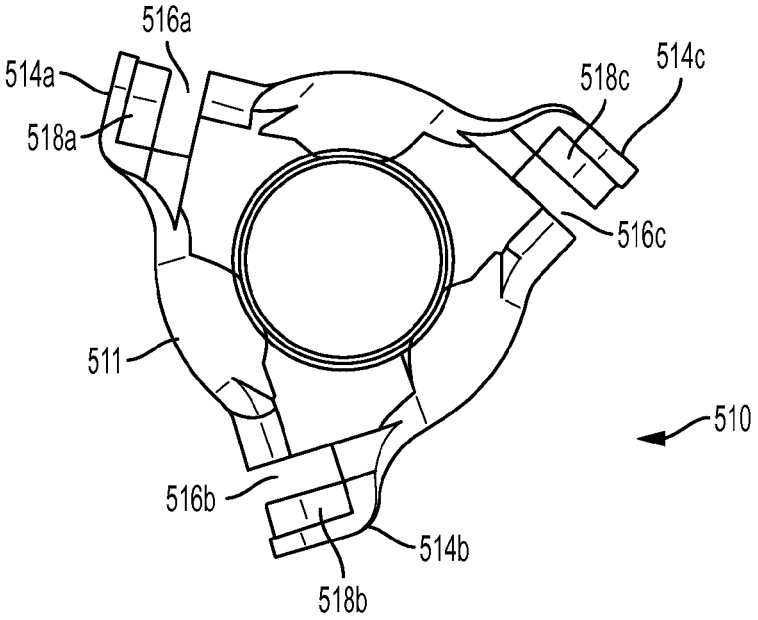
FIG. 6D is an exemplary front view of an embodiment of the shock collar for the three-bladed expandable broadhead shown in FIG. 5A and FIG. 5B.

FIGS. 6A-D are exemplary displays of an embodiment of a collar 510 of the present invention. FIG. 6A is a first exemplary perspective view of collar 510. FIG. 6B is a second exemplary perspective view of collar 510. FIG. 6C is an exemplary rear view of collar 510, and FIG. 6D is an exemplary front view of collar 510. As discussed above, in some embodiments of the present invention, rear cylindrical portion 512 acts as a centering shim for a broadhead 500. Frangible tabs 514*a*, 514*b*, and 514*c* of forward portion 511 each include a respective seating location 518*a*, 518*b*, and 518*c*, which is configured to receive a hook 535*a*, 535*b*, and 535*c* of the respective blades 530*a*, 530*b*, and 530*c*.

Frangible tabs 514*a*, 514*b*, and 514*c* are configured to break off of collar 510 upon the broadhead 500's impact into a target, allowing the blades 530*a*, 530*b*, and 530*c* of the expandable broadhead 500 to deploy outwards. Each frangible tab 514*a*, 514*b*, and 514*c* retains the hooks 535*a*, 535*b*, and 535*c* of the respective blades 530*a*, 530*b*, and 530*c* within each of the seating locations 518*a*, 518*b*, and 518*c* of the frangible tabs 514*a*, 514*b*, and 514*c* during flight, minimizing rattling and shaking of the broadhead 500's blades 530*a*, 530*b*, and 530*c* during flight and ensuring improved aerodynamic performance.

In embodiments of the present invention, the collar 510 is composed of one or more shock absorbing materials. In embodiments of the present invention, the shock absorbing materials can be nylon, polypropylene, PMMA, glass filled nylon, polycarbonate, aluminum, zinc, powder metal, polymeric materials, elastomeric materials, composites, and ceramics.

Examples of ceramic materials for use in the present invention include silicon nitride ($Si_3N_4$), silicon carbide (SiC), aluminum oxide ($Al_2O_3$), zirconium oxide ($ZrO_2$), tungsten carbide (WC), and partially stabilized zirconia. Examples of powder metal for use in the present invention include both sintered powder metal and injection molded powder metal, and the powder metal can be composed of any of stainless steel, brass, bronze, and titanium.

In embodiments of the present invention, the one or more shock absorbing materials of the collar 510 are impregnated with one or more friction reducing additives. Examples of friction reducing additives include polytetrafluoroethylene (PTFE), graphite, molybdenum disulfide ($MoS_2$), and nanoparticles, such as zinc or silica nanoparticles. The friction reducing additives advantageously reduce the coefficient of friction of the one or more shock absorbing materials, reducing the friction between mating components in the broadhead 500. The ferrule body 520 and blades 530*a*, 530*b*, and 530*c* can similarly be impregnated with the one or more friction reducing additives, as described above.

In embodiments of the present invention, structural weaknesses, such as cuts 516*a*, 516*b*, and 516*c*, are built into each of the plurality of frangible tabs 514*a*, 514*b*, and 514*c*, which enhance the ability of the frangible tabs 514*a*, 514*b*, and 514*c* to break off of the collar 510 upon impact of the broadhead 500 into a target, ensuring that the blades 530*a*, 530*b*, and 530*c* of the broadhead 500 deploy outwards and cause maximum damage to the target. These cuts 516*a*, 516*b*, and 516*c* are structural weaknesses that allow the frangible tabs 514*a*, 514*b*, and 514*c* to be sized such that a commensurate amount of applied force will break the frangible tabs 514*a*, 514*b*, and 514*c* off of the collar 510 upon impact.

Figure 7A:
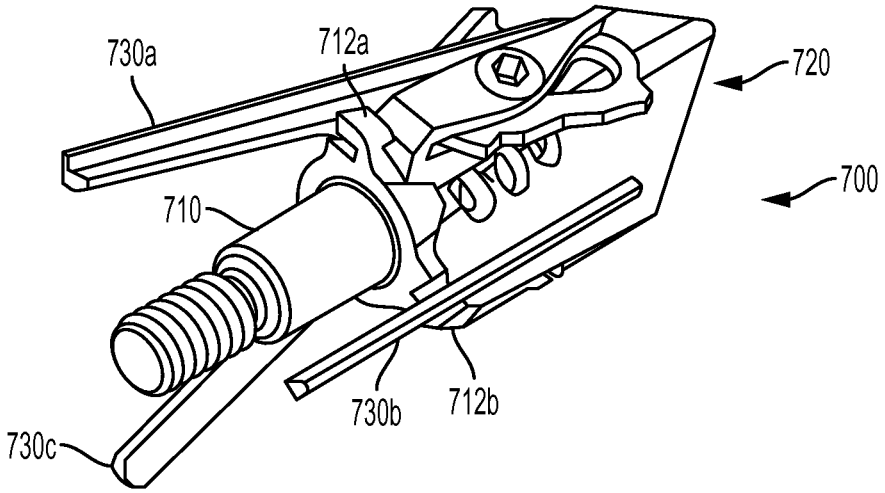
FIG. 7A is an exemplary perspective view of an embodiment of a three-bladed expandable broadhead in an in-flight configuration.
Figure 7B:
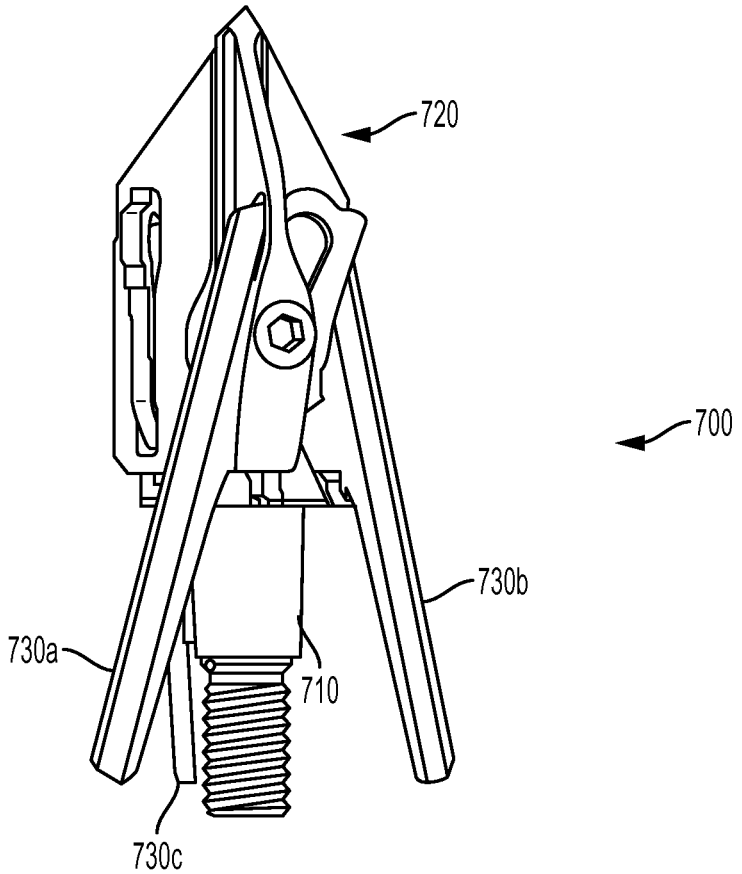
FIG. 7B is a first exemplary side view of the three-bladed expandable broadhead of FIG. 7A in an in-flight configuration.
Figure 7C:
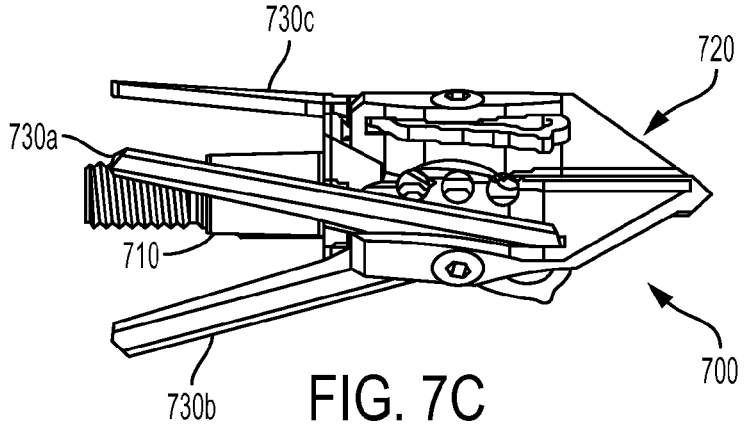
FIG. 7C is a second exemplary side view of the three-bladed expandable broadhead of FIG. 7A in an in-flight configuration.
Figure 7D:
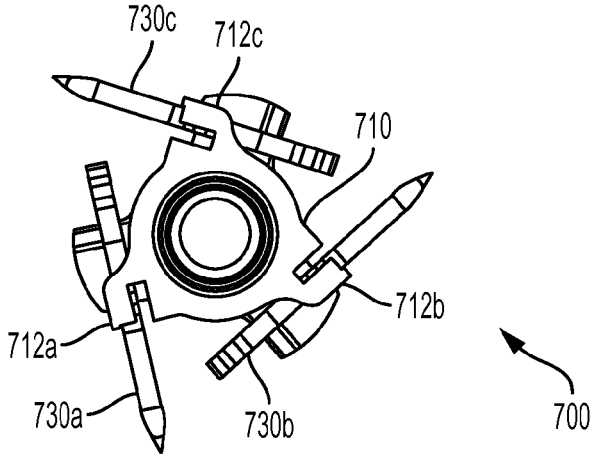
FIG. 7D is an exemplary rear view of the three-bladed expandable broadhead of FIG. 7A in an in-flight configuration.
Figure 7E:
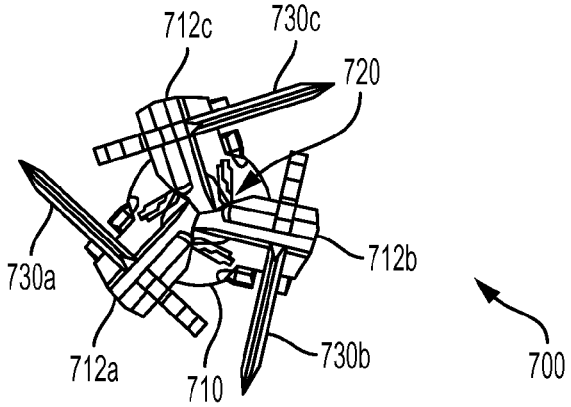
FIG. 7E is an exemplary front view of the three-bladed expandable broadhead of FIG. 7A in an in-flight configuration.

FIG. 7A is a perspective view of the in-flight configuration of an exemplary three-bladed broadhead 700 embodiment of the present invention. Frangible tabs 712*a*, 712*b*, and 712*c* of shock collar 710 retain blades 730*a*, 730*b*, and 730*c* of the broadhead 700 against ferrule body 720 to maximize aerodynamic performance of broadhead 700 during flight. FIG. 7B is a first side view of the in-flight configuration of broadhead 700. FIG. 7C is a second side view of the in-flight configuration of broadhead 700. FIG. 7D is a rear view of the in-flight configuration of broadhead 700. FIG. 7E is a front view of the in-flight configuration of broadhead 700.

Figure 8A:
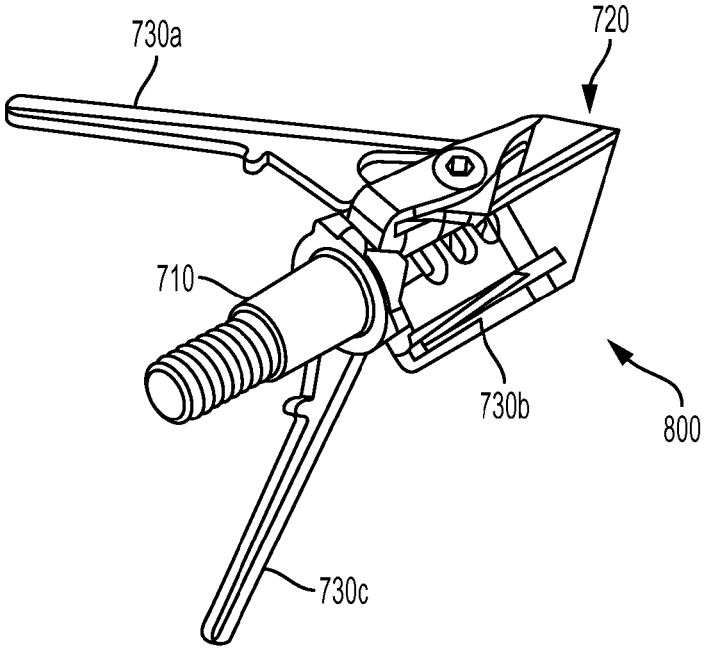
FIG. 8A is an exemplary perspective view of the three-bladed expandable broadhead of FIGS. 7A, 7B, 7C, 7D, and 7E in a fully deployed configuration.
Figure 8B:
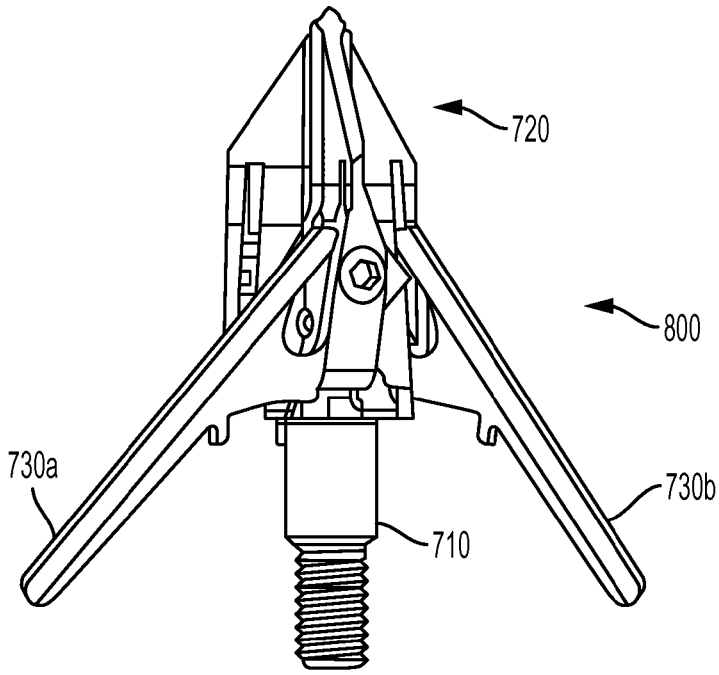
FIG. 8B is a first exemplary side view of the three-bladed expandable broadhead of FIGS. 7A, 7B, 7C, 7D, and 7E in a fully deployed configuration.
Figure 8C:
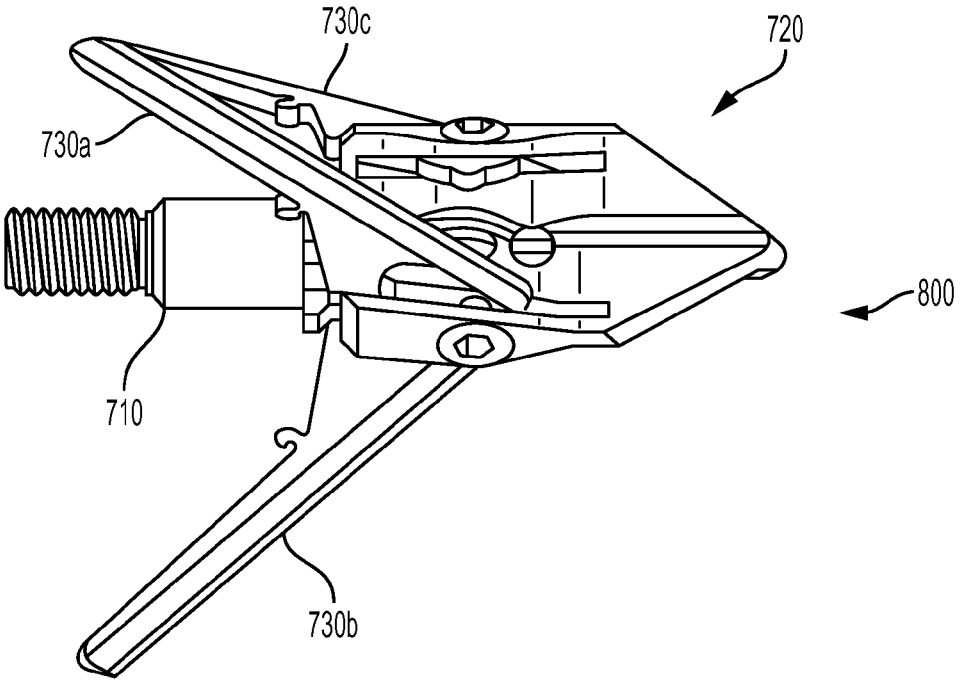
FIG. 8C is a second exemplary side view of the three-bladed expandable broadhead of FIGS. 7A, 7B, 7C, 7D, and 7E in a fully deployed configuration.
Figure 8D:
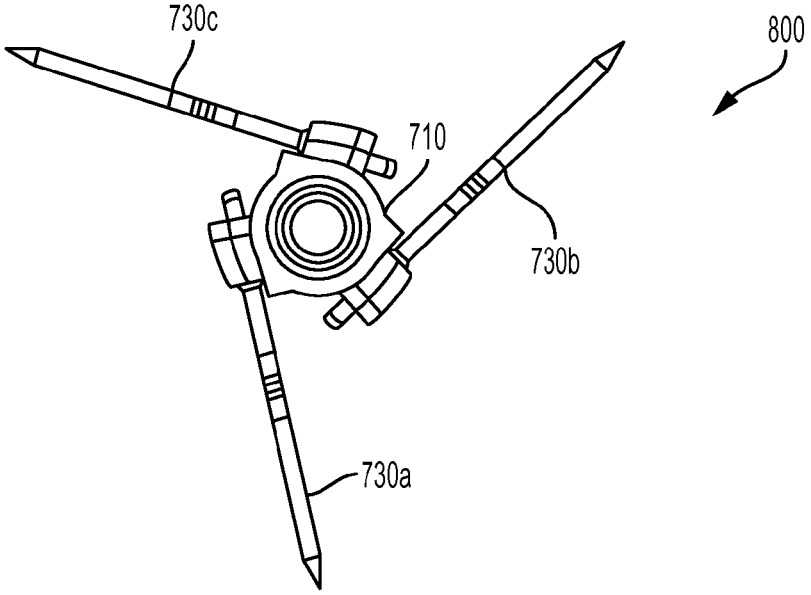
FIG. 8D is an exemplary rear view of the three-bladed expandable broadhead of FIGS. 7A, 7B, 7C, 7D, and 7E in an a fully deployed configuration.
Figure 8E:
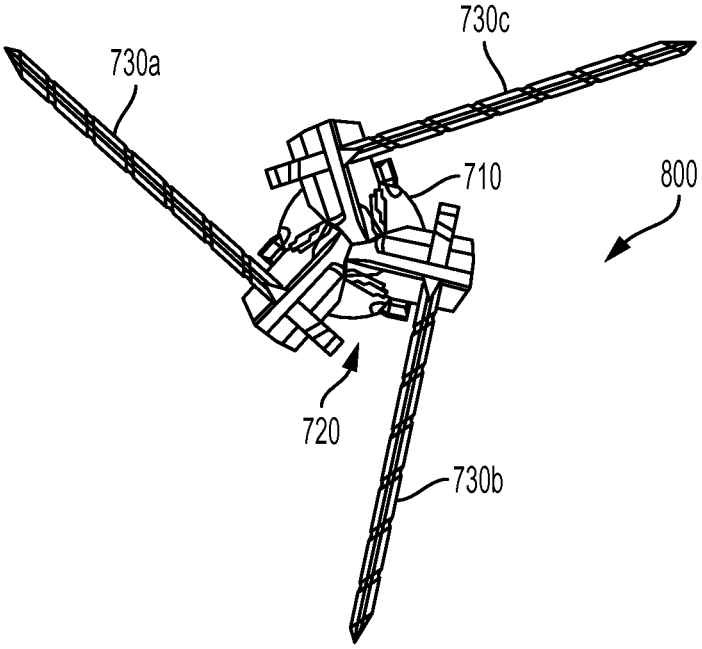
FIG. 8E is an exemplary front view of the three-bladed expandable broadhead of FIGS. 7A, 7B, 7C, 7D, and 7E in a fully deployed configuration.

FIG. 8A is a perspective view of the fully deployed configuration of an exemplary three-bladed broadhead 800 of the present invention. Frangible tabs 712*a*, 712*b*, and 712*c* are no longer shown in this view, as they have broken off shock collar 710, allowing blades 730*a*, 730*b*, and 730*c* of the broadhead 800 to rotate outward from the ferrule body 720 into a deployed configuration, ensuring that the broadhead 800 maximizes the size of the entrance hole in its target. FIG. 8B is a first side view of the fully deployed configuration of broadhead 800. FIG. 8C is a second side view of the fully deployed configuration of broadhead 800. FIG. 8D is a rear view of the fully deployed configuration of broadhead 800. FIG. 8E is a front view of the fully deployed configuration of broadhead 800.

Figure 9A:
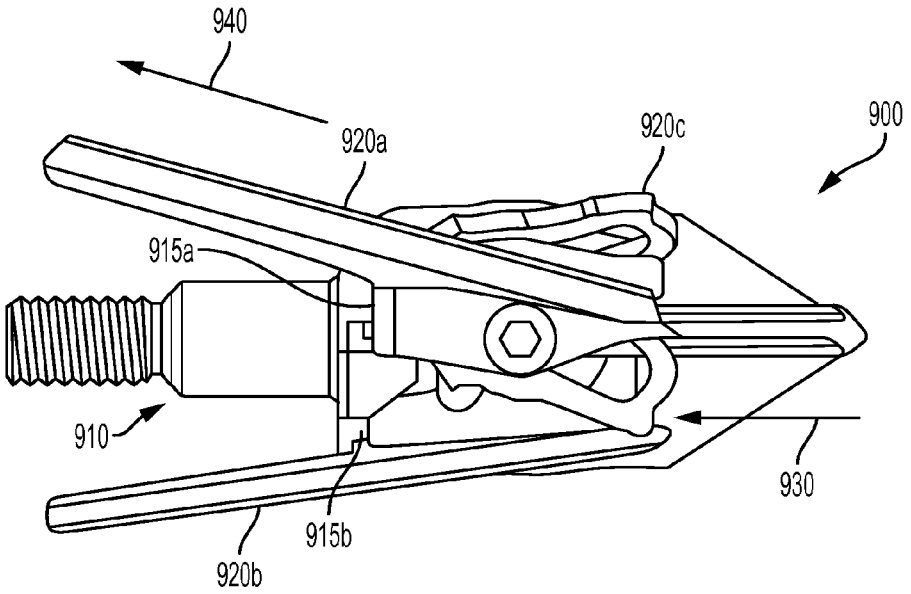
FIG. 9A is a first exemplary side view of an embodiment of a three-bladed expandable broadhead in an in-flight configuration.
Figure 9B:
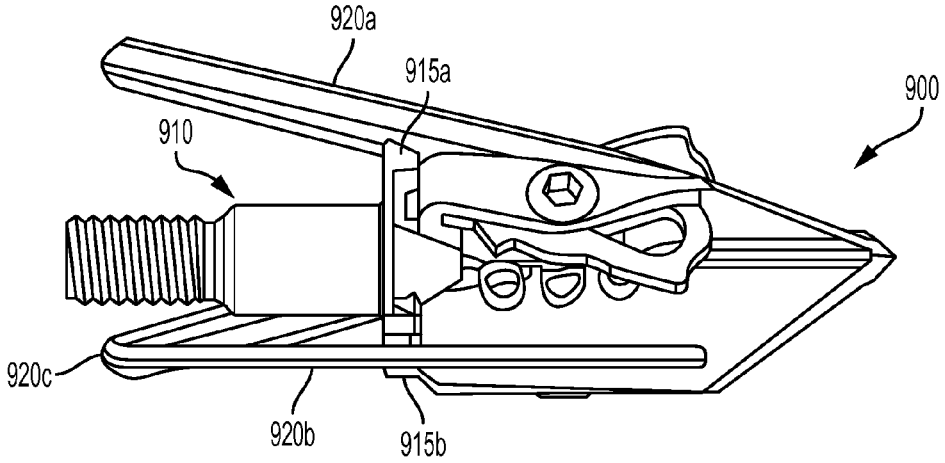
FIG. 9B is a second exemplary side view of the three-bladed expandable broadhead of FIG. 9A in an in-flight configuration.

FIG. 9A is a first exemplary side view of an exemplary three-bladed broadhead embodiment 900 at the moment of impact into a target (not pictured). As the broadhead 900 begins to penetrate into the target, the target's surface makes contact with blades 920*a*, 920*b*, and 920*c* of the broadhead 900, which causes blades 920*a*, 920*b*, and 920*c* to exert both axial 930 and tangential 940 forces on frangible tabs 915*a*, 915*b*, and 915*c* of collar 910. FIG. 9B is a second exemplary side view of broadhead 900.

Figure 10A:
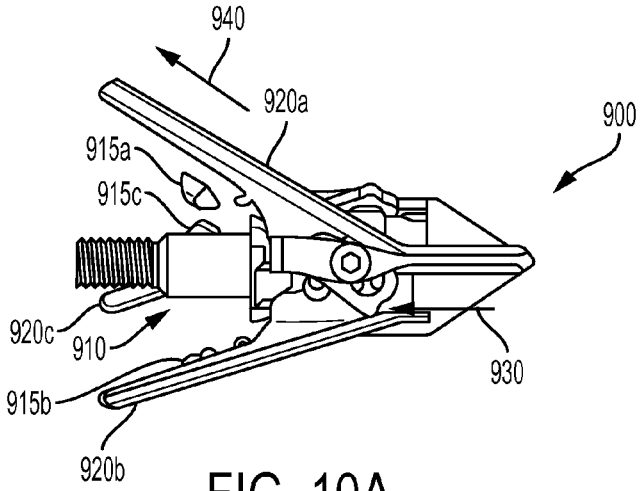
FIG. 10A is a first exemplary side view of the three-bladed expandable broadhead of FIG. 9A and FIG. 9B in a deployed configuration.
Figure 10B:
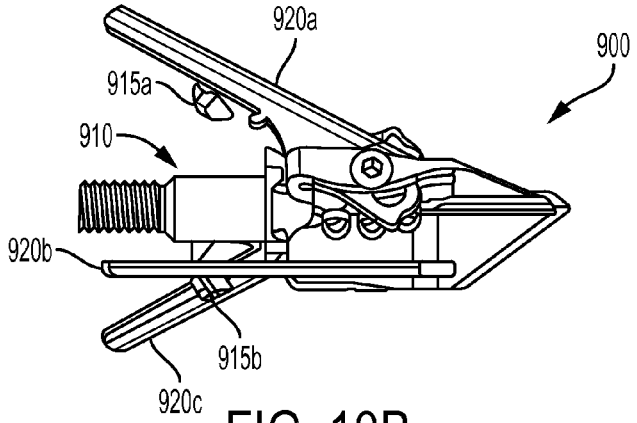
FIG. 10B is a second exemplary side view of the three-bladed expandable broadhead of FIG. 9A and FIG. 9B in a deployed configuration.
Figure 10C:
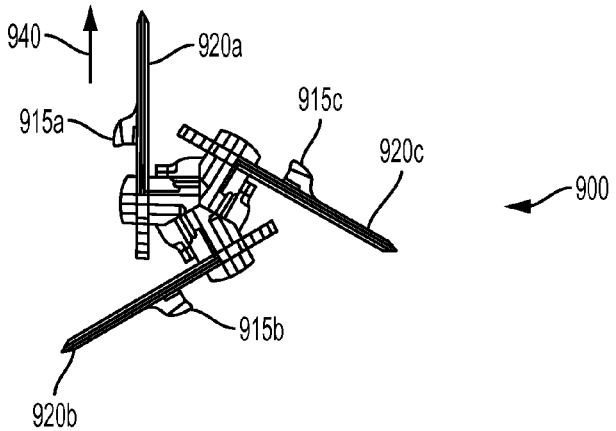
FIG. 10C is an exemplary front view of the three-bladed expandable broadhead of FIG. 9A and FIG. 9B in a deployed configuration.

FIG. 10A is a first exemplary side view of the exemplary three-bladed broadhead embodiment 900 moments after impact, as the axial 930 and tangential 940 forces exerted by blades 920*a*, 920*b*, and 920*c* have caused frangible tabs 915*a*, 915*b*, and 915*c* to break off of collar 910, allowing blades 920*a*, 920*b*, and 920*c* to deploy outwards. FIG. 10B is a second exemplary side view of broadhead 900, and FIG. 10C is a front view of broadhead 900.

Figure 11A:
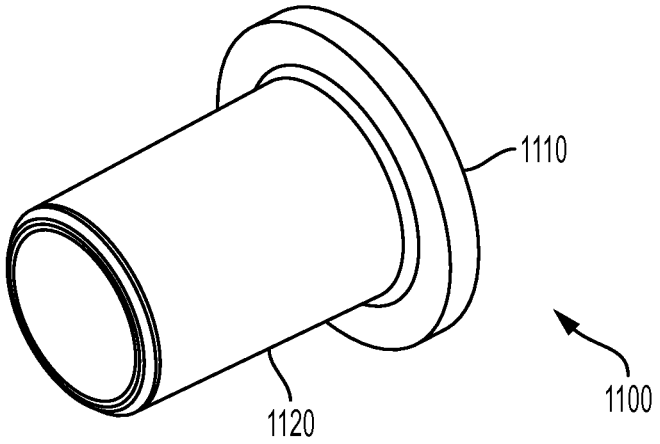
FIG. 11A is a first exemplary perspective view of a first embodiment of a broadhead collar.
Figure 11B:
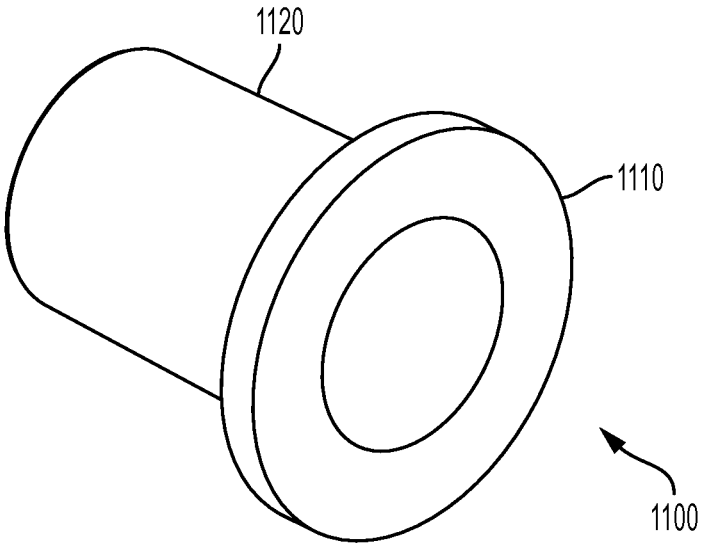
FIG. 11B is a second exemplary perspective view of the broadhead collar of FIG. 11A.

FIG. 11A is a first perspective view of another embodiment of a collar 1100 in accordance with the present invention. As discussed above, in various embodiments of the present invention, collar 1100 acts as a centering shim for a broadhead in the front portion of an arrow shaft (not pictured), centering and stabilizing the broadhead within the arrow insert. In embodiments of the invention, the circular portion 1110 is engaged against the ferrule body of the broadhead, while the rear cylindrical portion 1120 covers the outside of a trailing portion of the ferrule and is shaped to fill a volume of space between that trailing portion of the ferrule and the arrow into which the broadhead is inserted. FIG. 11B is a second perspective view of the collar 1100 shown in FIG. 11A.

In embodiments of the invention, collar 1100 is composed of a polymeric material such as nylon, polypropylene, and PMMA, whereas the ferrule body covered by the collar 1100 is typically made from a metal substrate, such as steel, stainless steel, or titanium. Typically, without a layer between the metal ferrule and the metal arrow insert, the ferrule and the arrow insert require some small amount of clearance between them (typically, approximately 0.002 inches), which can result in a slightly off-center placement of a ferrule within an arrow. However, because the polymeric material of the collar 1100 in embodiments of the present invention is capable of deforming more readily than the metal material of the ferrule, it is possible to have the clearance between the collar 1100 and the arrow insert into which the broadhead is inserted be an interference fit. This allows the collar 1100 to cause nearly perfect centering of a broadhead within the arrow insert.

In embodiments of the invention, the material of collar 1100 is typically lighter and less dense than the heavier material of the ferrule. In an embodiment, collar 1100 has a density of approximately 0.04 $lb/in^3$, whereas the ferrule material has a density in the range of approximately 0.09 $lb/in^3$ to 0.29 $lb/in^3$. This advantageously allows a broadhead equipped with collar 1100 to be approximately 0.001 lbs (or 7 grains) lighter than a broadhead in which a thicker ferrule alone centers the broadhead within an arrow insert. Alternatively, a broadhead equipped with collar 1100 can utilize the 7 grains of weight elsewhere in the broadhead, resulting in greater strength, durability, performance, and effectiveness.

Figure 12A:
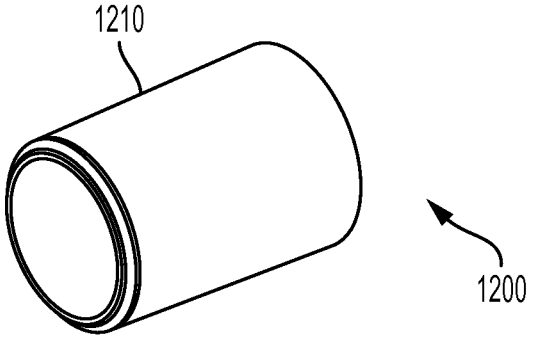
FIG. 12A is a first exemplary perspective view of a second embodiment of a broadhead collar.
Figure 12B:
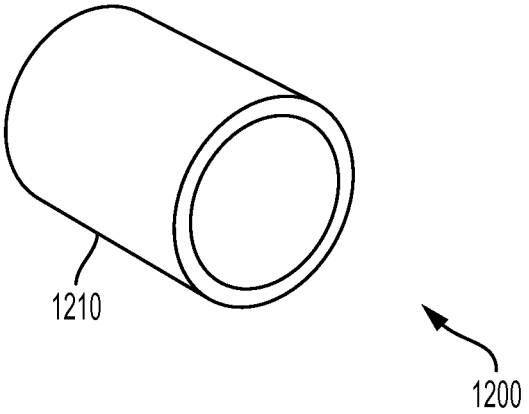
FIG. 12B is a second exemplary perspective view of the broadhead collar of FIG. 12A.

FIG. 12A is a first perspective view of another embodiment of a collar 1200 in accordance with the present invention. This collar 1200 includes only a cylindrical portion 1210 designed to cover the ferrule of a broadhead. FIG. 12B is a second perspective view of collar 1200. One of ordinary skill in the art will readily recognize that the collars of the present invention could take different forms to match different styles of broadheads, including but not limited to fixed blade broadheads, cartridge style expandable broadheads, pivoting expandable broadheads, over-the-top expandable broadheads, and hybrid broadheads.

Figure 13A:
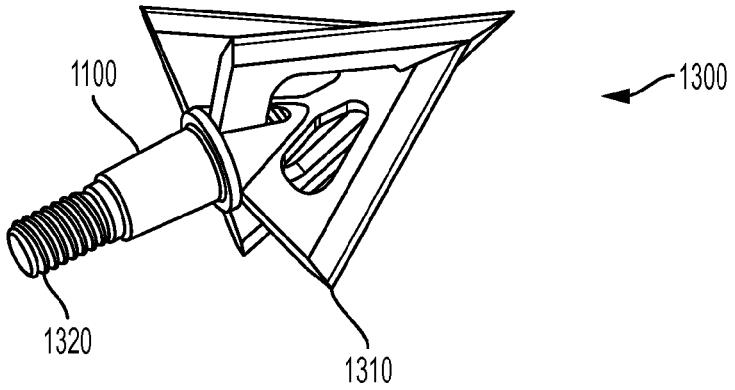
FIG. 13A is an exemplary perspective view of a fixed blade broadhead and an embodiment of a broadhead collar.
Figure 13B:
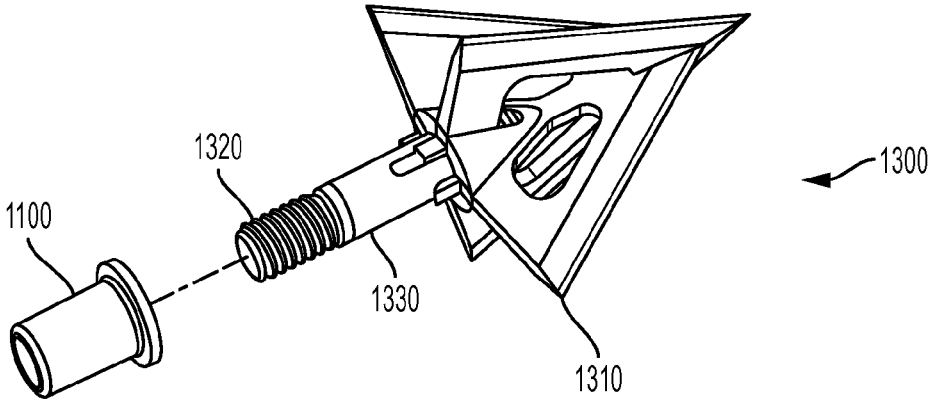
FIG. 13B is an exemplary exploded perspective view of the fixed blade broadhead and embodiment of a broadhead collar as shown in FIG. 13A.

FIG. 13A is a perspective view of a fixed broadhead 1300 with an exemplary collar 1100 of the present invention. FIG. 13B is an exploded view of the broadhead 1300 displayed in FIG. 13A, illustrating how collar 1100 fits over the outside of ferrule portion 1330, as well as fixed-blade portion 1310 and threaded portion 1320 for insertion into an arrow.

Figure 14A:
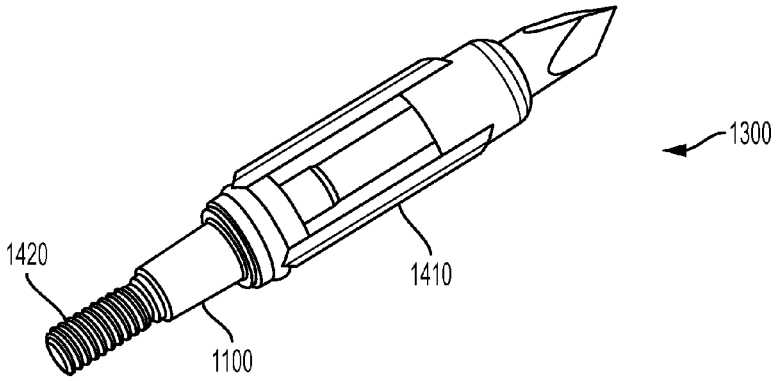
FIG. 14A is an exemplary perspective view of a cartridge-style expandable broadhead and an embodiment of a broadhead collar in an in-flight configuration.
Figure 14B:
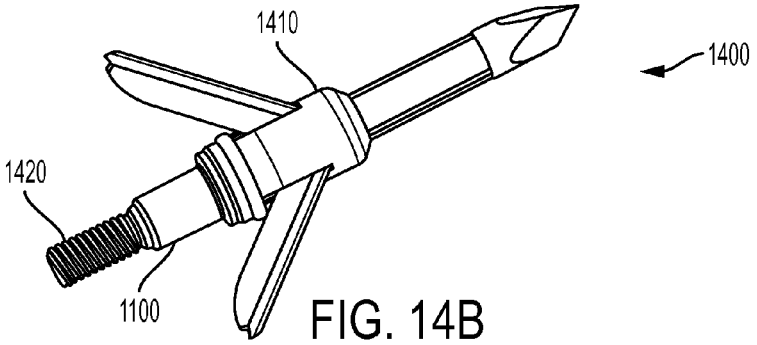
FIG. 14B is an exemplary perspective view of a cartridge-style expandable broadhead and an embodiment of a broadhead collar, as shown in FIG. 14A, in a deployed configuration.
Figure 14C:
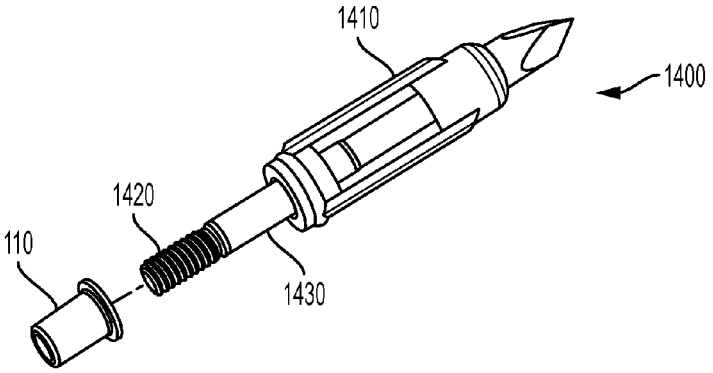
FIG. 14C is an exemplary exploded perspective view of the cartridge-style expandable broadhead and embodiment of a broadhead collar as shown in FIG. 14A.

FIG. 14A is a perspective view of a cartridge style expandable broadhead 1400 in its in-flight configuration with an exemplary collar 1100 of the present invention, and FIG. 14B is a perspective view of broadhead 1400 in its fully deployed configuration. FIG. 14C is an exploded view of the broadhead 1400 displayed in FIG. 14A, illustrating how collar 1100 fits over the outside of ferrule portion 1430, as well as cartridge style ferrule 1410 and threaded portion 1420 for insertion into an arrow.

Figure 15A:
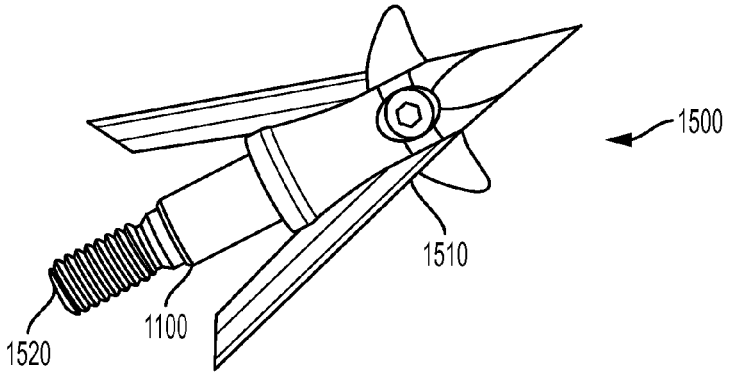
FIG. 15A is an exemplary perspective view of a pivoting expandable broadhead and an embodiment of a broadhead collar in an in-flight configuration.
Figure 15B:
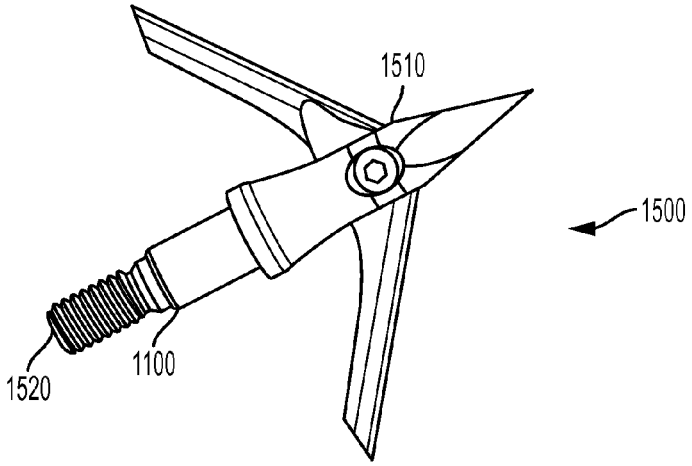
FIG. 15B is an exemplary perspective view of a pivoting expandable broadhead and an embodiment of a broadhead collar, as shown in FIG. 15A, in a deployed configuration.
Figure 15C:
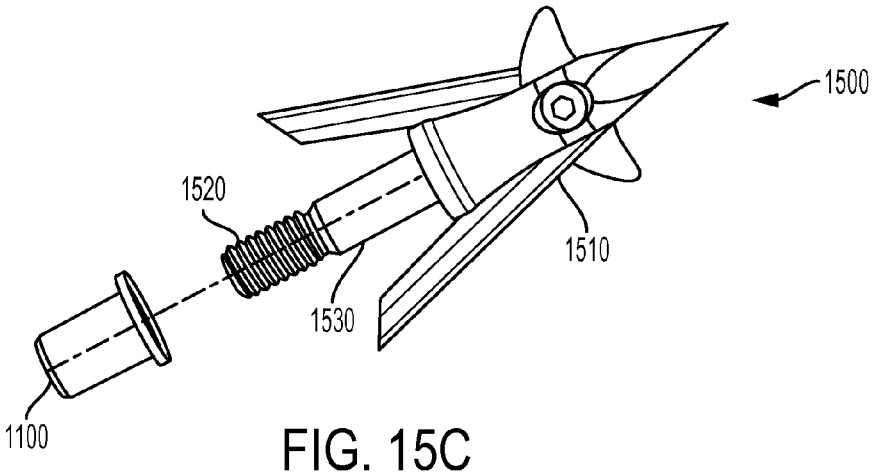
FIG. 15C is an exemplary exploded perspective view of the pivoting expandable broadhead and embodiment of a broadhead collar as shown in FIG. 15A.

FIG. 15A is a perspective view of a pivoting expandable broadhead 1500 in its in-flight configuration with an exemplary collar 1100 of the present invention, and FIG. 15B is a perspective view of broadhead 1500 in its fully deployed configuration. FIG. 15C is an exploded view of the broadhead 1500 displayed in FIG. 14A, illustrating how collar 1100 fits over the outside of ferrule portion 1530, as well as pivoting expandable ferrule 1510 and threaded portion 1520 for insertion into an arrow.

Figure 16A:
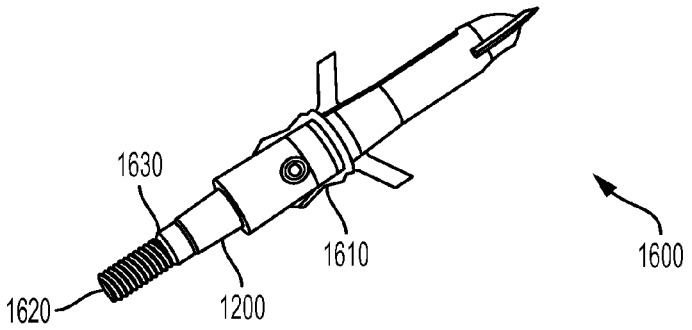
FIG. 16A is an exemplary perspective view of a first over-the-top expandable broadhead and an embodiment of a broadhead collar in an in-flight configuration.
Figure 16B:
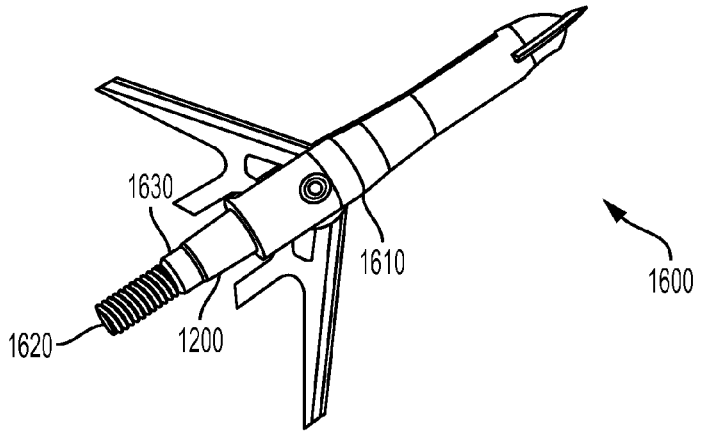
FIG. 16B is an exemplary perspective view of a first over-the-top expandable broadhead and an embodiment of a broadhead collar, as shown in FIG. 16A, in a deployed configuration.
Figure 16C:
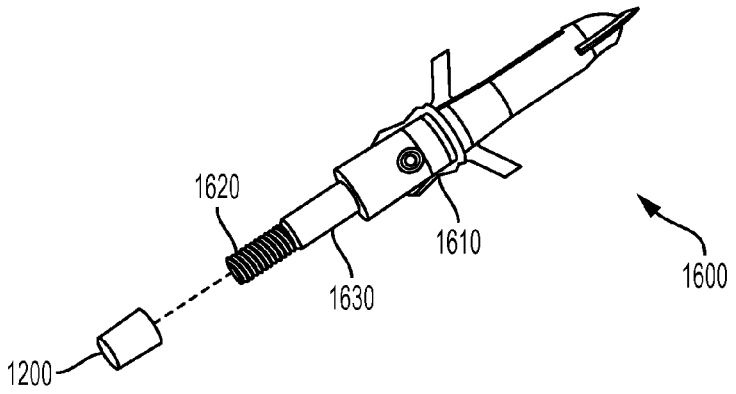
FIG. 16C is an exemplary exploded perspective view of the first over-the-top expandable broadhead and embodiment of a broadhead collar as shown in FIG. 16A.

FIG. 16A is a perspective view of a first over-the-top expandable broadhead 1600 in its in-flight configuration with an exemplary collar 1200 of the present invention, and FIG. 16B is a perspective view of broadhead 1600 in its fully deployed configuration. FIG. 16C is an exploded view of the broadhead 1600 displayed in FIG. 16A, illustrating how collar 1200 fits over the outside of ferrule portion 1630, as well as first over-the-top expandable ferrule 1610 and threaded portion 1620 for insertion into an arrow.

Figure 17A:
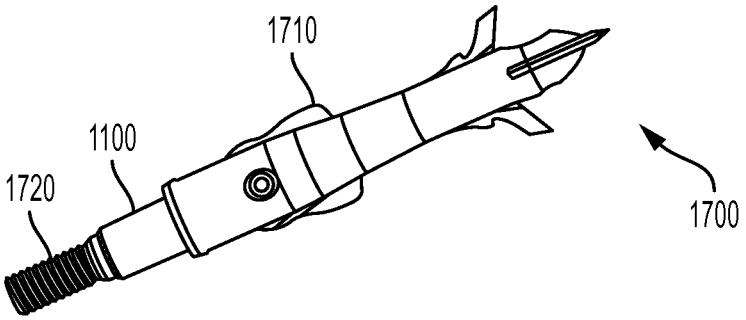
FIG. 17A is an exemplary perspective view of a second over-the-top expandable broadhead and an embodiment of a broadhead collar in an in-flight configuration.
Figure 17B:
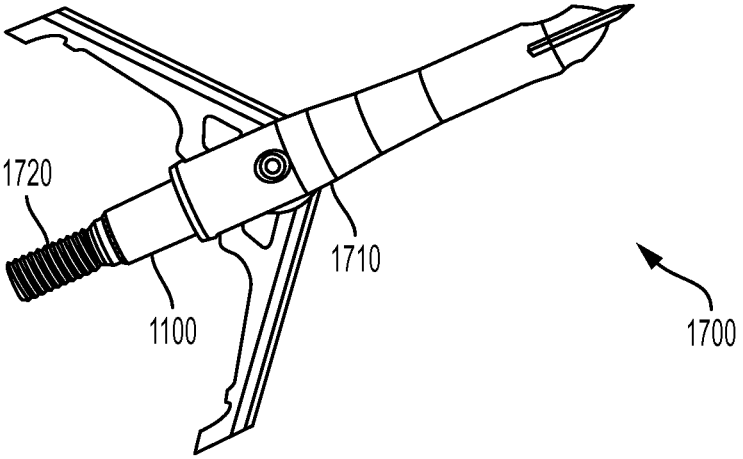
FIG. 17B is an exemplary perspective view of a second over-the-top expandable broadhead and an embodiment of a broadhead collar, as shown in FIG. 17A, in a deployed configuration.
Figure 17C:
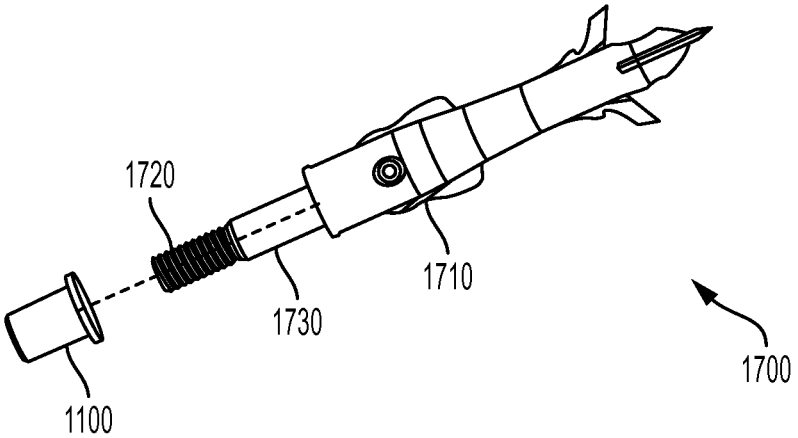
FIG. 17C is an exemplary exploded perspective view of the second over-the-top expandable broadhead and embodiment of a broadhead collar as shown in FIG. 17A.

FIG. 17A is a perspective view of a second over-the-top expandable broadhead 1700 in its in-flight configuration with an exemplary collar 1100 of the present invention, and FIG. 17B is a perspective view of broadhead 1700 in its fully deployed configuration. FIG. 17C is an exploded view of the broadhead 1700 displayed in FIG. 17A, illustrating how collar 1100 fits over the outside of ferrule portion 1730, as well as second over-the-top expandable ferrule 1710 and threaded portion 1720 for insertion into an arrow.

Figure 18:
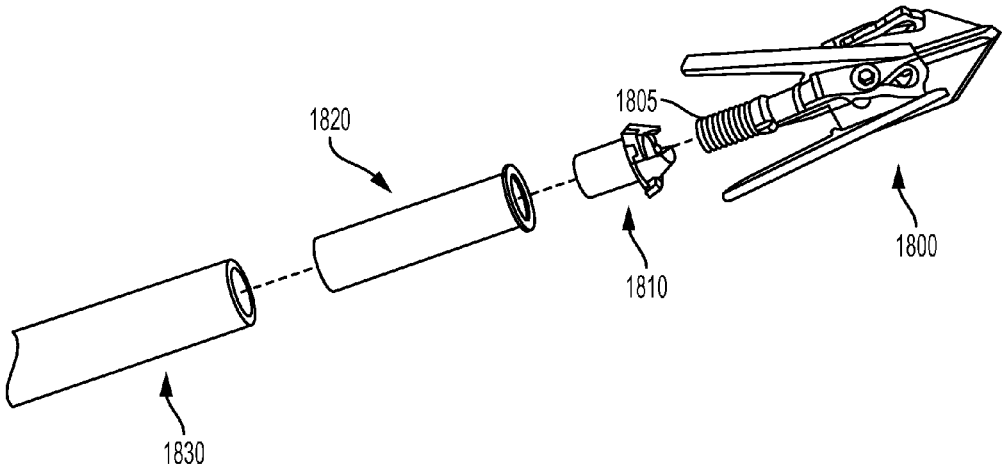
FIG. 18 is an exemplary exploded perspective view of a three-bladed expandable broadhead, a shock collar, an arrow insert, and an arrow shaft.

FIG. 18 is an exploded perspective view of an expandable broadhead 1800 in its in-flight configuration, with an exemplary collar 1810 of the present invention. FIG. 18A illustrates how collar 1810 fits over the rear portion 1805 of the ferrule of broadhead 1800, resulting in an interference fit between the rear portion 1805 of the ferrule of broadhead 1800 and arrow insert 1820, and causing nearly perfect centering of broadhead 1800 within arrow insert 1820. Arrow insert 1820 is a threaded bore which is fitted within the front of arrow shaft 1830.

Embodiments of the present invention have been described for the purpose of illustration. Persons skilled in the art will recognize from this description that the described embodiments are not limiting, and may be practiced with modifications and alterations limited only by the spirit and scope of the appended claims which are intended to cover such modifications and alterations, so as to afford broad protection to the various embodiments of the invention and their equivalents.

The invention claimed is:

1. A blade retaining collar for use with an expandable broadhead, the collar comprising a forward portion and a rear cylindrical portion, the forward portion comprising:

a plurality of frangible tabs, each tab configured to restrain a deployable blade of the expandable broadhead in a first position, wherein each of the plurality of frangible tabs is configured to break off of the collar upon an impact of the expandable broadhead, allowing each of the deployable blades to rotate and translate into a second position; and the rear cylindrical portion is configured to reside on an outer portion of a ferrule of the expandable broadhead, and configured to center the ferrule within an insert in an arrow.

2. The blade retaining collar of claim 1, wherein the impact of the expandable broadhead causes each deployable blade of the expandable broadhead to apply axial and tangential forces to the respective frangible tab configured to restrain the deployable blade.

3. The blade retaining collar of claim 2, wherein the axial and tangential forces cause the respective frangible tab to break off of the collar.

4. The blade retaining collar of claim 2, wherein the forward portion comprises three frangible tabs, and the expandable broadhead comprises three deployable blades.

5. The blade retaining collar of claim 1, wherein each of the plurality of frangible tabs comprises a cut which facilitates the ability of each of the plurality of frangible tabs to break off of the collar upon the impact.

6. The blade retaining collar of claim 1, wherein each of the plurality of frangible tabs comprises a seating location configured to receive a hook of the respective deployable blade which the frangible tab is configured to restrain.

7. The blade retaining collar of claim 6, wherein each of the plurality of frangible tabs is overlaid on the hook of the respective deployable blade which the frangible tab is configured to restrain.

8. The blade retaining collar of claim 7, wherein each of the plurality of frangible tabs restrain a respective blade during flight of the arrow.

9. The blade retaining collar of claim 1, wherein the collar comprises one or more shock absorbing materials selected from the group consisting of nylon, polypropylene, polymethylmethacrylate (PMMA), glass filled nylon, polycarbonate, aluminum, zinc, powder metal, and ceramic.

10. The blade retaining collar of claim 9, wherein the shock absorbing material is impregnated with one or more friction reducing additives selected from the group consisting of polytetrafluoroethylene (PTFE), graphite, molybdenum disulfide ($MoS_2$), and nanoparticles.

11. The blade retaining material of claim 10, wherein the one or more friction reducing additives reduces the coefficient of friction of the one or more shock absorbing materials.

12. The blade retaining collar of claim 9, wherein the ceramic is a ceramic material selected from the group consisting of silicon nitride ($Si_3N_4$), silicon carbide (SiC), aluminum oxide ($Al_2O_3$), zirconium oxide ($ZrO_2$), tungsten carbide (WC), and partially stabilized zirconia.

13. The blade retaining collar of claim 9, wherein the powder metal is a sintered powder metal.

14. The blade retaining collar of claim 9, wherein the powder metal is an injection molded powder metal.

15. The blade retaining collar of claim 9, wherein the powder metal comprises one of the group consisting of stainless steel, brass, bronze, and titanium.

16. The blade retaining collar of claim 1, wherein the size of the rear cylindrical portion creates an interference fit between the outer portion of the ferrule and the insert in the arrow.

17. The blade retaining collar of claim 16, wherein the ferrule comprises steel, and the rear cylindrical portion is comprised of one or more polymeric materials selected from the group consisting of nylon, polypropylene, and polymethylmethacrylate (PMMA).

18. The blade retaining collar of claim 16, wherein the rear cylindrical portion has a density of approximately 0.04 $lb/in^3$, and the ferrule has a density in the range of approximately 0.09 $lb/in^3$ to 0.29 $lb/in^3$.

19. A blade retaining collar for use with a broadhead, the collar comprising:

a cylindrical portion, wherein the cylindrical portion resides on an outer portion of a ferrule of the broadhead, and the size of the cylindrical portion creates an interference fit between the outer portion of the ferrule of the broadhead and an insert in an arrow, wherein a material of the cylindrical portion deforms more readily than a material of the ferrule.

20. A blade retaining collar for use with a broadhead, the collar comprising:

a cylindrical portion, wherein the cylindrical portion resides on an outer portion of a ferrule of the broadhead, and the size of the cylindrical portion creates an interference fit between the outer portion of the ferrule of the broadhead and an insert in an arrow, wherein the ferrule comprises steel, and the cylindrical portion is comprised of one or more polymeric materials selected from the group consisting of nylon, polypropylene, and polymethylmethacrylate (PMMA).

21. A blade retaining collar for use with a broadhead, the collar comprising:

a cylindrical portion, wherein the cylindrical portion resides on an outer portion of a ferrule of the broadhead, and the size of the cylindrical portion creates an interference fit between the outer portion of the ferrule of the broadhead and an insert in an arrow, wherein the collar comprises one or more shock absorbing materials selected from the group consisting of nylon, polypropylene, polymethylmethacrylate (PMMA), glass filled nylon, polycarbonate, aluminum, zinc, powder metal, and ceramic.

22. The blade retaining collar of claim 21, wherein the shock absorbing material is impregnated with one or more friction reducing additives selected from the group consisting of polytetrafluoroethylene (PTFE), graphite, molybdenum disulfide ($MoS_2$), and nanoparticles.

23. A blade retaining collar for use with a broadhead, the collar comprising:

a cylindrical portion, wherein the cylindrical portion resides on an outer portion of a ferrule of the broadhead, and the size of the cylindrical portion creates an interference fit between the outer portion of the ferrule of the broadhead and an insert in an arrow, wherein the cylindrical portion has a density of approximately 0.04 $lb/in^3$, and the ferrule has a density in the range of approximately 0.09 $lb/in^3$ to 0.29 $lb/in^3$.

* * * * *